US009695620B2

(12) United States Patent
Zasowski et al.

(10) Patent No.: US 9,695,620 B2
(45) Date of Patent: Jul. 4, 2017

(54) APPARATUS AND METHOD FOR ROTATING TUBE ADJUSTMENT AND VISUALLY INDICATING SPRING FORCE IN A DOOR OPERATOR OR CLOSER

(71) Applicant: Yale Security, Inc., Monroe, NC (US)

(72) Inventors: Peter Zasowski, Yantis, TX (US); Dustin Lawhon, Lilesville, NC (US); Robert M. Bell, Bowling Green, KY (US)

(73) Assignee: Yale Security Inc., Monroe, NC (US)

( * ) Notice: Subject to any disclaimer, the term of this patent is extended or adjusted under 35 U.S.C. 154(b) by 0 days.

(21) Appl. No.: 14/872,281

(22) Filed: Oct. 1, 2015

(65) Prior Publication Data

US 2016/0097230 A1 Apr. 7, 2016

Related U.S. Application Data

(60) Provisional application No. 62/058,824, filed on Oct. 2, 2014.

(51) Int. Cl.
*E05F 1/08* (2006.01)
*E05F 1/10* (2006.01)

(52) U.S. Cl.
CPC ..... *E05F 1/105* (2013.01); *E05Y 2600/12* (2013.01); *E05Y 2900/132* (2013.01)

(58) Field of Classification Search
CPC ... Y10T 16/281; Y10T 16/299; Y10T 16/286; Y10T 16/27; Y10T 16/56; Y10T 16/585; Y10T 16/568; Y10T 16/62; Y10T 16/17; E05F 3/00; E05F 3/108; E05F 3/02; E05F 3/04; E05F 3/06; E05F 3/08; E05F 3/22; E05F 2900/132; E05Y 2201/21; E05Y 2201/218; E05Y 3/221
See application file for complete search history.

(56) References Cited

U.S. PATENT DOCUMENTS 1,632,924 A * 6/1927 Schmidt ..... E05F 1/105 16/72
2,453,924 A * 11/1948 McFadden ..... A01J 11/16 366/263
2,540,525 A * 2/1951 Howarth ..... F16F 1/12 248/542
2,996,754 A * 8/1961 Ziegler ..... E05F 3/108 16/52
3,161,908 A * 12/1964 Walach ..... E05F 3/108 16/52

(Continued)

*Primary Examiner* — Chuck Mah
(74) *Attorney, Agent, or Firm* — DeLio, Peterson & Curcio, LLC; Peter W. Peterson

(57) ABSTRACT

An apparatus for adjusting the force in a door operator or closer includes a tube rotatable about a longitudinal axis and a coil spring therein connected to door operator/closer. A fixed adjusting screw extends along the longitudinal axis of the housing through the coil spring and a spring collar is threaded onto the adjusting screw and rotatable with the tube. The spring collar bears on the distal end of the spring to vary the spring compression upon rotation of the housing and thereby vary force applied by the door operator or closer. The housing has an opening though which the spring is visible, and the tube has markings indicating the degree of spring compression. An indicator is moveable along and visible outside the housing to indicate the compression of the spring.

26 Claims, 3 Drawing Sheets

(56) References Cited

U.S. PATENT DOCUMENTS 3,335,451 A * 8/1967 Patriquin ..... E05F 3/108 16/52
3,531,820 A * 10/1970 Koivusalo ..... E05F 3/108 16/52
3,555,591 A * 1/1971 Sogoian ..... E05F 3/16 16/49
3,593,367 A * 7/1971 Waldo ..... E05F 3/02 16/66
3,708,826 A * 1/1973 Larson ..... E05F 3/108 16/52
3,781,943 A * 1/1974 Cain ..... E05F 3/108 16/52
3,934,307 A * 1/1976 Lasier ..... E05F 1/105 16/62
4,103,881 A * 8/1978 Simich ..... F16F 1/128 248/623
4,545,322 A * 10/1985 Yang ..... F16F 7/08 16/85
4,590,639 A * 5/1986 Fritsche ..... E05F 3/10 116/204
4,686,739 A 8/1987 Fritsche et al.
4,783,882 A 11/1988 Frolov
5,163,204 A * 11/1992 Jackson ..... B63B 43/30 16/66
5,265,306 A 11/1993 Yu
5,657,511 A * 8/1997 Lan ..... E05F 3/02 16/51
5,666,692 A * 9/1997 Toledo ..... E05F 3/104 16/51
5,687,507 A * 11/1997 Beran ..... E05F 15/63 49/339
6,282,750 B1 9/2001 Bishop et al.
6,871,381 B1 * 3/2005 Luca ..... E05F 3/108 16/52
7,025,343 B2 4/2006 Chou
7,070,375 B2 * 7/2006 Hoeckelman ..... F16B 19/109 269/48.1
8,732,905 B2 5/2014 Bell

* cited by examiner

APPARATUS AND METHOD FOR ROTATING TUBE ADJUSTMENT AND VISUALLY INDICATING SPRING FORCE IN A DOOR OPERATOR OR CLOSER

This application claims priority from U.S. patent application No. 62/058,824 filed on Oct. 2, 2014.

BACKGROUND OF THE INVENTION

1. Field of the Invention

The present invention is directed to door or window closers and openers, and apparatus to adjust the force applied to close a door.

2. Description of Related Art

Door or window closers or operators may utilize a compression spring to apply force to close the door or window. As utilized herein, the term door also includes a window that is similarly operated, e.g., by pivoting movement on a pivot or hinge. An embodiment of a typical prior art door closer 120 is shown in FIG. 1 and includes a closer housing 122 that in part defines a substantially cylindrical reservoir 124, a piston 126 and compression spring 130 biased against the piston 126. A rack 138 is attached to the piston 26. The rack 138 is driven by a pinion 140 through engagement with the teeth 142 of the pinion 140. The pinion 140 is connected to a closer arm assembly (not shown) for operably coupling the door closer 120 to a door. FIG. 1 shows the door closer 120 in a position corresponding to a closed door. As the door is opened, the pinion 140 rotates in an initial direction, transporting the rack 138 and consequently sliding the piston 126 to the right as shown in FIG. 1. The compression spring 130 urges the piston 126 and rack 138 to the left in FIG. 1. When the force of the compression spring 130 overcomes the input force from the door and pinion 140 such as when the door is released, the compression spring 130 will force the piston 126 to the left in FIG. 1, and the pinion 140 will rotate in a direction opposite the initial direction and the door closer 120 will act to close the door.

The spring in a door closer or operator indirectly applies force to the door in the closing direction. The amount of spring force or tension is determined by the geometry of the spring and the amount of preload applied by compressing the spring from its static length. Presently, adjusting the spring setting in closers is often done with an adjusting screw using a tool to turn the adjusting screw. U.S. Pat. No. 8,732,905 discloses an example of a door or window closer using an adjusting screw that has an external end that is turned by a nut, knob or socket.

Determining the spring force setting of a closer or operator on a door is typically done by counting the number of turns on the spring adjust screw on the closer. However, there is no indication of the current spring preload prior to adjustment or after past adjustments unless documented. It must then be checked by measuring the force on the door. It would be beneficial to the installers to be able to visually tell where the spring force is set while installing the closer.

Tools are typically required to make these adjustments. It would be easier for the installers or maintenance people to be able to set or adjust the spring pressure without the use of tools.

SUMMARY OF THE INVENTION

Bearing in mind the problems and deficiencies of the prior art, it is therefore an object of the present invention to provide an improved apparatus to adjust the force applied to close a door.

It is another object of the present invention to provide a visual means of viewing the actual direct position and setting of the spring in a door operator or closer.

A further object of the invention is to provide a door operator or closer that permits the installer or user to set the spring force setting by hand, without the use of a tool.

Still other objects and advantages of the invention will in part be obvious and will in part be apparent from the specification.

The above and other objects, which will be apparent to those skilled in the art, are achieved in the present invention which is directed to an apparatus for adjusting the force in a door operator or closer for closing a door comprising a housing rotatable about a longitudinal axis and a spring within the housing and connected to door operator or closer. Compression of the spring operates to vary force applied by the door operator or closer. The apparatus further comprises an adjusting screw extending along the longitudinal axis of the housing and a spring collar threaded onto the adjusting screw and rotatable with the housing. The spring collar bears on the spring to vary the spring compression upon rotation of the housing and thereby vary force applied by the door operator or closer.

The spring collar may bear against the spring collar end distal from the door operator or closer. The spring may be a coil spring and the adjusting screw may extend through the coil spring. The adjusting screw may not turn or move upon rotation of the tube or spring collar.

The housing may have an opening though which the spring is visible. The tube may have one or more markings thereon the indicating the degree of spring compression. The apparatus may further include an indicator moveable along and visible outside the housing to indicate the compression of the spring.

The housing may be a tube coaxially disposed about the longitudinal axis. The tube may have a slot extending longitudinally along a wall of the tube, and the spring collar may have a tab extending into the tube slot. The tube slot permits the tab and spring collar to move longitudinally with respect to the tube while preventing the tab and spring collar from rotation as the tube is rotated. The spring collar tab may be adapted to move longitudinally along the slot as the tube is rotated, and the spring collar tab may be at least partially visible through the slot to indicate the compression of the spring.

In a related aspect, the present invention is directed to a method of adjusting the force in a door operator or closer for closing a door comprising providing a housing rotatable about a longitudinal axis, a spring within the tube and connected to door operator or closer and a spring collar rotatable with the housing. The spring collar bears on the spring. The method further includes rotating the housing to vary compression of the spring, thereby varying force applied by the door operator or closer to close the door.

There may be further included an adjusting screw extending along the longitudinal axis of the housing, and the spring collar may be threaded onto the adjusting screw.

The housing may be rotated clockwise or counterclockwise to increase or decrease the spring compression and the force applied by the door operator or closer. The housing may be rotated without the use of a tool. The housing may be a tube coaxially disposed about the longitudinal axis and of a diameter permitting it to be rotated by hand.

The present invention in another aspect provides an apparatus for adjusting the force in a door operator or closer for closing a door comprising a housing having a sidewall with an opening therein and a spring within the housing and connected to door operator or closer. The spring is compressible to different positions to vary force applied by the door operator or closer. The position of the spring is viewable from the exterior of the housing through the sidewall opening.

The housing may be rotatable about a longitudinal axis and may further include an adjusting screw extending along the longitudinal axis of the housing and a spring collar threaded onto the adjusting screw and rotatable with the housing. The spring collar bears on the spring to vary the spring compression upon rotation of the housing and thereby vary force applied by the door operator or closer. At least a portion of the spring collar may be viewable from the exterior of the housing through the sidewall opening.

In another related aspect the present invention provides a method of adjusting the force in a door operator or closer for closing a door comprising providing an apparatus for adjusting the force in a door operator or closer for closing a door as described above. The method includes compressing the spring to a desired position to apply a desired force to the door operator or closer and viewing the position of the spring from the exterior of the housing through the sidewall opening. The method may also include rotating the housing to extend the spring to the desired position to apply the desired force to the door operator or closer.

The spring collar may have a tab extending into the opening in the housing sidewall, with the spring collar tab being adapted to move longitudinally along the opening in the housing sidewall as the housing is rotated. The spring collar tab may be at least partially visible through the opening in the housing sidewall to indicate the compression of the spring. The method may further include viewing the position of the spring collar tab from the exterior of the housing through the sidewall opening to determine the position of the spring and the force applied by the spring to the door operator or closer.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

In describing the embodiment(s) of the present invention, reference will be made herein to FIGS. 1-5 of the drawings in which like numerals refer to like features of the invention.

Figure 1:
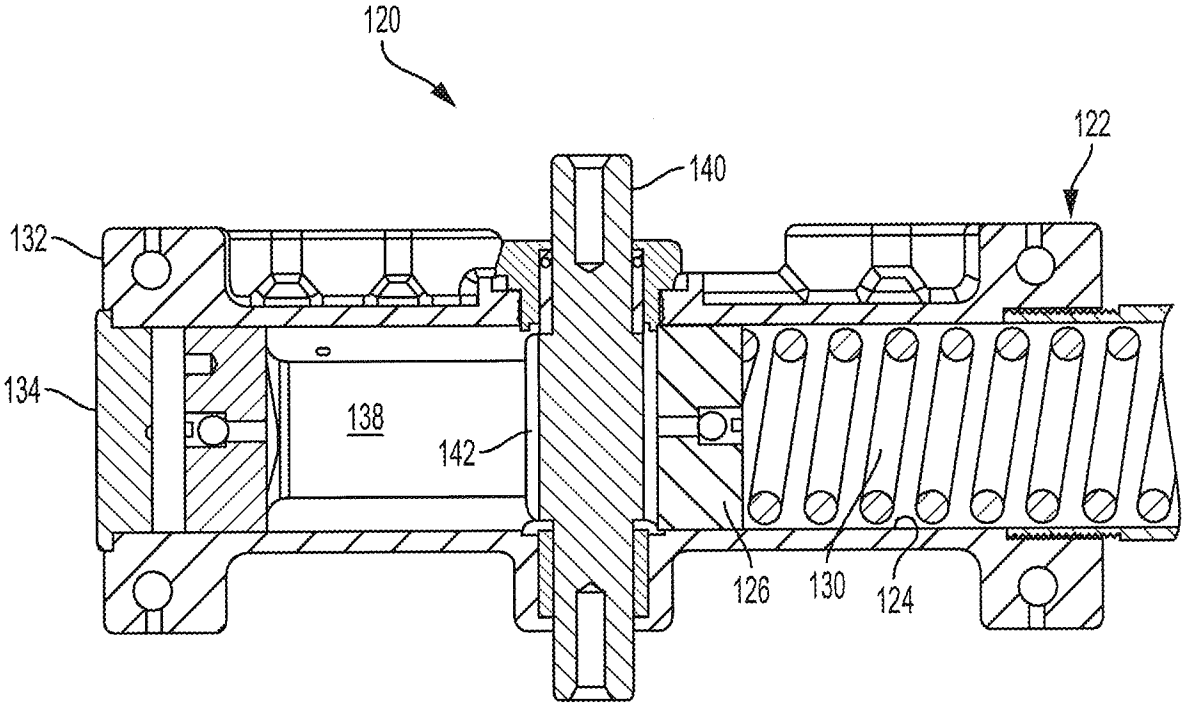
FIG. 1 PRIOR ART
FIG. 1 is a side cross-sectional view of a prior art door closer.
Figure 2:
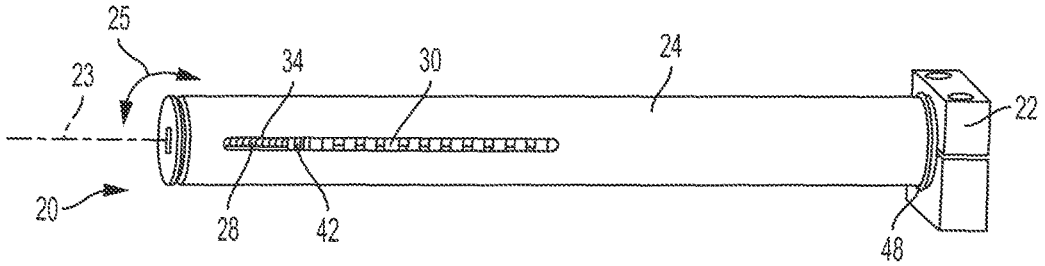
FIG. 2 is a perspective view of a spring adjuster and indicator made in accordance with the present invention, mounted on a door operator or closer.
Figure 3:
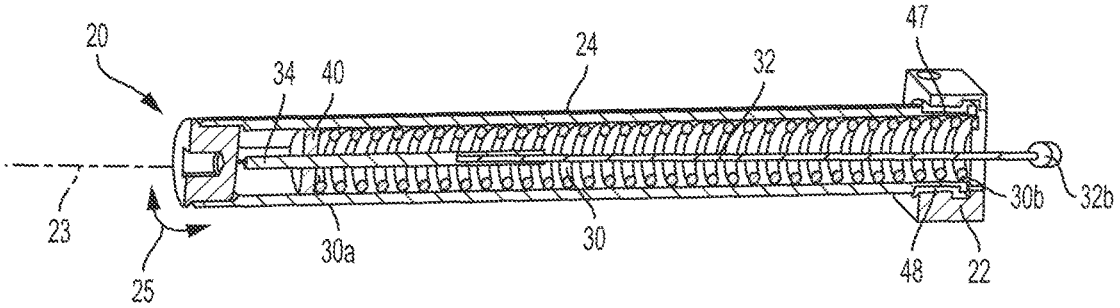
FIG. 3 is a sectional perspective view of the spring adjuster and indicator of FIG. 2.
Figure 4:
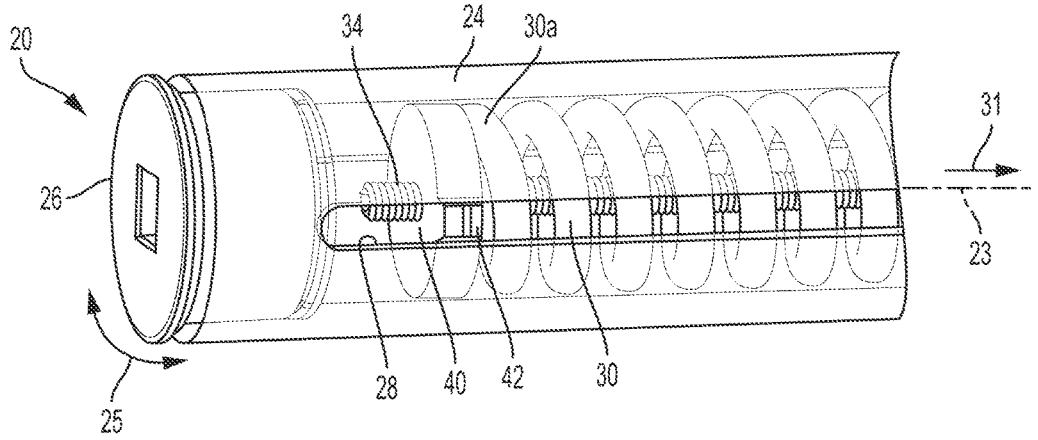
FIG. 4 is a close-up perspective view of the end portion of the spring adjuster and indicator of FIG. 2 showing the internal details of the spring, spring collar and spring adjustment indicator.

The spring adjuster and indicator 20 of present invention can be used on any otherwise conventional door closer or operator 22 (FIGS. 2 and 3) that uses a linearly adjustable spring for applying the desired degree of force for closing the door, such as the door closer 120 of FIG. 1. The spring in the door operator/closer indirectly applies force to the door in the closing direction. The door closer or operator 22 is affixed to a door or a frame for the door (not shown), and has a dampening mechanism (not shown) that resists the force of the spring and controls the speed at which the door closes. The closer spring is pre-loaded so that it applies force on the dampening mechanism and door even when the door is closed, which degree of pre-stress must be overcome when the door is initially opened. The amount of spring force is determined by the geometry of the spring and its degree of compression, i.e., the amount of preload applied by compressing the spring from its static length. The present invention permits *facile* adjustment of this spring force by hand, without the use of tools.

The spring adjuster and indicator 20 includes a housing 24 in the form of an elongated tube and, inside, compression coil spring 30 which applies the door-closing force to door operator/closer 22 at proximal end 30*b*. Instead of the one spring 30 shown, more than one spring may be utilized, such as a smaller diameter coil spring inside of spring 30. Housing tube 24 is secured within door operator/closer 22 by a shoulder fitted within bushing 48 so that the tube is rotatable with respect to the fixed door operator or closer in both directions 25 about longitudinal axis 23. An end cap 26 closes the distal end of tube 24, and may have a socket opening for screwing the cap into the tube end. Along and inside the longitudinal axis 23 of the tube and spring is rod 32 attached to operator/closer 22 at proximal end 32*b*, which rod includes adjusting screw threads 34 along all or a portion of its length. A spring collar 40 may be threaded onto the adjusting screw threads 34, so that the adjustment screw passes through the spring collar, and bears against the distal end 30*a* of spring 30. Spring collar 40 includes a tab 42 extending radially outward from the collar, which collar tab is received within and slideable in slot or window 28 extending along a length of and through the side wall of tube 24. Tab 42 is fixed against rotational movement in the slot and with respect to the tube, so that spring collar 40 rotates in directions 25 and turns as the tube 24 is rotated. Alternately, the collar and tube may have any non-circular shape such that the relative rotational motion between the collar and tube is restricted. As the tube and spring collar are rotated one revolution, tab 42 slides along slot 28 a distance equal to the pitch of screw 34.

Since adjusting rod 32 is rotationally fixed with respect to closer operator body 22 and screw 34 is rotationally fixed at end 32*b* and does not rotate, rotation 25 of housing tube 24 causes tab 42 and spring collar 40 to rotate correspondingly and move linearly on and along threads 34. As spring collar 40 moves linearly toward or away from operator/closer 22, it causes spring 30 to increase or decrease the degree of compression of the spring length, respectively. The selected degree of compression of the spring operates to vary the force applied by the door operator or closer, with a shorter extension (i.e., greater compression) applying more force, and a longer extension (i.e., less compression) applying less force.

Figure 5:
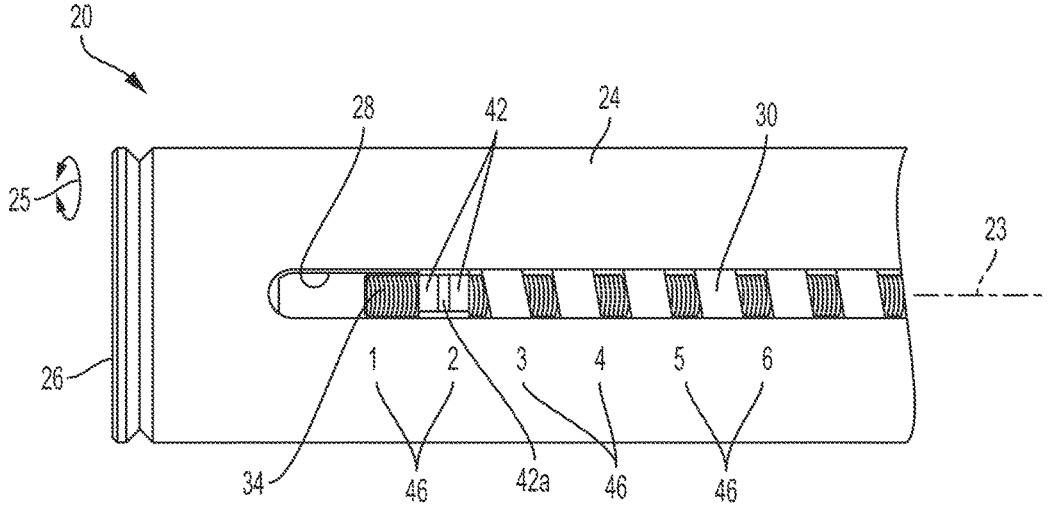
FIG. 5 is a side elevational view of the end portion of the spring adjuster and indicator of FIG. 2 showing the spring adjustment indicator and indicia.

The spring 30, spring collar 40, spring collar tab 42 and position of the spring and spring collar linearly along axis 23 may be visible through slot opening 28. A layer of transparent or translucent glass or plastic may be fitted over the slot. The length of the slot 28 in tube 24 may be selected to be substantially the length of travel available for spring collar 40. As shown in FIG. 5, spring collar tab 42 may have a mark 42*a* thereon, which is indexable along markings or indicia 46, for example numerals 1-6, adjacent the slot and extending along the length of the tube exterior. The position of tab mark 42*a* with respect to markings 46 indicate the spring setting of the closer and the preload of the spring on the closer 22.

In operation, the user turns tube 24 clockwise or counterclockwise 25, which causes spring collar to move along the length of screw threads 34 and tab 42 to slide linearly along the length of slot 28. As the spring tube is turned and the spring collar moves linearly along axis 23, the spring either compresses or relaxes, thus changing the preload of the spring to increase or decrease the force on the door operator/closer. The compression of the spring can be seen through the window 28 in the tube and provides a visual indicator of the closer setting, based on spring force. The position of the spring collar, which may be converted to and indicates the amount of force applied by spring 30, is indicated by the position of tab mark 42*a* and indicia 46 marked on the tube. This enables the user to easily see the setting to which the door operator/closer is adjusted or set.

Significantly, the adjusting screw of the present invention does not turn during adjustment of the spring tension and, instead, the spring tension is adjusted by rotating the spring tube clockwise or counterclockwise to increase or decrease the spring force. The spring collar is threaded onto the screw and fixed in the slot of the tube, therefore as the tube is rotated, the spring collar moves linearly in the slot while the adjusting screw does not rotate, thus changing the preload of the spring. The entire spring tube of the present invention may be rotated by the user's hand to linearly move the spring collar along an adjusting screw to change the preload of the spring. The compression of the spring may be seen through a slot or window extending along the length of the spring tube.

Accordingly, the present invention provides a visual means of seeing the actual direct position and setting of the spring in a door operator/closer. The invention also permits the installer or user to set the spring force setting by turning the tube by hand, without the use of a separate tool or tools to turn the adjusting screw.

While the present invention has been particularly described, in conjunction with a specific embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An apparatus for adjusting the force in a door operator or closer for closing a door comprising:

a housing having a sidewall and an opening in the sidewall; and a spring within the housing and connected to door operator or closer, the spring applying the force by the door operator or closer to close the door, the spring being compressible to different positions to vary force applied by the door operator or closer, position of the spring being viewable from the exterior of the housing through the sidewall opening.

2. The apparatus of claim 1 further including:

an adjusting screw extending along the longitudinal axis of the housing; and a spring collar on the adjusting screw, the spring collar bearing on the spring and being adjustable to vary the spring compression and thereby vary force applied by the door operator or closer, at least a portion of the spring collar being viewable from the exterior of the housing through the sidewall opening.

3. The apparatus of claim 2 wherein the adjustment screw passes through the spring collar.

4. The apparatus of claim 3 wherein the spring collar is threaded onto the adjusting screw.

5. The apparatus of claim 4 wherein the position of the spring collar is adjustable by hand, without the use of tools.

6. The apparatus of claim 1 wherein the housing is rotatable about a longitudinal axis and further including:

an adjusting screw extending along the longitudinal axis of the housing; and a spring collar threaded onto the adjusting screw and rotatable with the housing, the spring collar bearing on the spring and being adjustable to vary the spring compression upon rotation of the housing and thereby vary force applied by the door operator or closer, at least a portion of the spring collar being viewable from the exterior of the housing through the sidewall opening.

7. A method of adjusting the force by a door operator or closer for closing a door comprising:

providing a housing having a sidewall and an opening in the sidewall, and a spring within the housing and connected to door operator or closer, the spring being compressible to different positions to vary force applied by the door operator or closer, position of the spring being viewable from the exterior of the housing through the sidewall opening;

compressing the spring to a desired position to apply a desired force by the door operator or closer; and viewing the position of the spring from the exterior of the housing through the sidewall opening.

8. The method of claim 7 including adjusting the position of the spring by hand, without the use of tools.

9. The method of claim 7 wherein the housing is rotatable about a longitudinal axis and includes an adjusting screw extending along the longitudinal axis of the housing, and a spring collar threaded onto the adjusting screw and rotatable with the housing, the spring collar bearing on the spring to vary the spring compression upon rotation of the housing and thereby vary force applied by the door operator or closer, with at least a portion of the spring collar being viewable from the exterior of the housing through the sidewall opening, and further including:

rotating the housing to extend the spring to the desired position to apply the desired force to the door operator or closer.

10. The method of claim 9 wherein the spring collar has a tab extending into the opening in the housing sidewall, the spring collar tab being adapted to move longitudinally along the opening in the housing sidewall as the housing is rotated, the spring collar tab being at least partially visible through the opening in the housing sidewall to indicate the compression of the spring, and further including:

viewing the position of the spring collar tab from the exterior of the housing through the sidewall opening to determine the position of the spring and the force applied by the spring to the door operator or closer.

11. An apparatus for adjusting the force in a door operator or closer for closing a door comprising:

a housing rotatable about a longitudinal axis;

a spring within the housing and connected to door operator or closer, compression of the spring operating to vary force applied by the door operator or closer;

an adjusting screw extending along the longitudinal axis of the housing; and a spring collar threaded onto the adjusting screw and rotatable with the housing, the spring collar bearing on the spring to vary the spring compression upon rotation of the housing and thereby vary force applied by the door operator or closer.

12. The apparatus of claim 11 wherein the spring has an end distal from the door operator or closer, and the spring collar bears against the spring distal end.

13. The apparatus of claim 11 wherein the spring is a coil spring and the adjusting screw extends through the coil spring.

14. The apparatus of claim 11 wherein the housing has an opening, the spring being visible through the housing opening.

15. The apparatus of claim 11 wherein the adjusting screw does not turn upon rotation of the housing or spring collar.

16. The apparatus of claim 11 wherein the adjusting screw does not move upon rotation of the housing or spring collar.

17. The apparatus of claim 11 further including one or more markings on the housing indicating the degree of spring compression.

18. The apparatus of claim 11 further including an indicator moveable along and visible outside the housing to indicate the compression of the spring.

19. The apparatus of claim 11 wherein the housing is a tube coaxially disposed about the longitudinal axis.

20. The apparatus of claim 19 wherein the tube has a slot extending longitudinally along a wall of the tube, and wherein the spring collar has a tab extending into the tube slot, the tube slot permitting the tab and spring collar to move longitudinally with respect to the tube while preventing the tab and spring collar from rotation with respect to the tube as the tube is rotated.

21. The apparatus of claim 19 wherein the tube has a slot extending longitudinally along a wall of the tube, and wherein the spring collar has a tab extending into the tube slot, the spring collar tab being adapted to move longitudinally along the slot as the tube is rotated, and the spring collar tab being at least partially visible through the slot to indicate the compression of the spring.

22. A method of adjusting the force by a door operator or closer for closing a door comprising:

providing a housing rotatable about a longitudinal axis; a spring within the housing and connected to door operator or closer; and a spring collar rotatable with the housing, the spring collar bearing on the spring; and rotating the housing to rotate the spring collar and vary compression of the spring, thereby varying force applied by the door operator or closer to close the door.

23. The method of claim 22 further including an adjusting screw extending along the longitudinal axis of the housing, and wherein the spring collar is threaded onto the adjusting screw.

24. The method of claim 22 wherein the housing is rotated clockwise or counterclockwise to increase or decrease the spring compression and the force applied by the door operator or closer.

25. The method of claim 22 wherein the housing is rotated by hand without the use of a tool.

26. The method of claim 22 wherein the housing is a tube coaxially disposed about the longitudinal axis and of a diameter permitting it to be rotated by hand without the use of a tool.

* * * * *